United States Patent [19]

Manus

[11] 4,226,411

[45] Oct. 7, 1980

[54] PLAYGROUND APPARATUS

[76] Inventor: Ray G. Manus, Rte. 5, Box 104, Lincolnton, N.C. 28092

[21] Appl. No.: 947,492

[22] Filed: Oct. 2, 1978

[51] Int. Cl.[3] ..... A63G 11/00

[52] U.S. Cl. ..... 272/55

[58] Field of Search ..... 272/54, 55, 56, 65, 272/66, 30, 141; 124/7; D21/251; 297/195, 196, 204, 208, 209, 210

[56] References Cited

U.S. PATENT DOCUMENTS

| | | | |
|---|---|---|---|
| 1,580,508 | 4/1926 | Liles | 272/55 |
| 1,635,931 | 7/1927 | Free | 272/55 |
| 1,654,169 | 12/1927 | Higginson | 272/55 UX |
| 1,850,927 | 3/1932 | Frederick | 272/55 |
| 2,201,036 | 5/1940 | Guerrier | 272/55 |
| 2,252,008 | 8/1941 | Joncas | 272/54 |
| 2,461,086 | 2/1949 | Schumacher | 272/66 |
| 2,926,911 | 3/1960 | Reichel | 272/141 X |
| 3,166,315 | 1/1965 | Jewett | 272/66 |
| 3,675,919 | 7/1972 | Ewers | 272/54 |

FOREIGN PATENT DOCUMENTS

| | | | |
|---|---|---|---|
| 406611 | 11/1924 | Fed. Rep. of Germany | 272/55 |
| 1055180 | 10/1953 | France | 272/66 |
| 104721 | 6/1942 | Sweden | 272/66 |

*Primary Examiner*—Richard C. Pinkham
*Assistant Examiner*—Arnold W. Kramer
*Attorney, Agent, or Firm*—Bell, Seltzer, Park & Gibson

[57] ABSTRACT

Playground apparatus of the teeter-totter or seesaw type for a plurality of riders which is characterized by completely individual movement of each rider wherein the movement of any one rider does not affect the movement of any other riders, as follows. A plurality of spaced-apart rocker arms are separately pivotally mounted to a vertically disposed support without interconnection to the other of the rocker arms for up and down movement. A biasing member is provided for each of the rocker arms for individually biasing the rocker arms in an upward direction and for allowing downward movement against the bias thereof. A rider supporting unit is on each of the outer ends of each of the rocker arms.

10 Claims, 6 Drawing Figures

PLAYGROUND APPARATUS

FIELD OF THE INVENTION

This invention relates to playground apparatus of the teeter-totter or seesaw type for a plurality of riders which is characterized by completely individual movement of each rider wherein the movement of any one rider does not affect the movement of any other rider.

BACKGROUND OF THE INVENTION

Playground apparatuses of the teeter-totter or seesaw type have become quite popular for children in recreational areas including public parks, nursery or day schools, back yards, etc. These apparatuses are generally of the type utilizing a central support, a plurality of spaced-apart rocker arms containing a rider supporting unit or seat on the outer end thereof and being connected together and to the support at the inner ends thereof. The apparatuses may include some sort of biasing means for biasing the rocker arms thereof in an upward direction.

One of the more popular of these teeter-totter or seesaw type playground apparatuses is marketed by Game-Time Inc. of Hillsdale, Michigan under the name "BUCK-A-BOUTS" and is purportedly constructed in accordance with their Ahrens U.S. Pat. No. 3,836,140, issued Sept. 17, 1974.

Additional examples of these types of playground apparatuses may be seen in the following additional U.S. Pat. Nos. considered with respect to the present invention.

| U.S. Patent Number | Inventor | Issue Date |
|---|---|---|
| 1,566,765 | A. Natale | Dec. 22, 1925 |
| 2,130,438 | P. H. Westerlund | Sept. 20, 1938 |
| 2,198,947 | E. V. Olson | April 30, 1940 |
| 2,542,359 | I. J. Rocklin | Feb. 20, 1951 |
| 3,089,699 | N. F. Flesch | May 14, 1963 |
| 3,292,924 | R. S. Wormser et al | Dec. 20, 1966 |
| 3,390,879 | L. F. French | July 2, 1968 |
| 3,675,919 | R. L. Ewers | July 11, 1972 |

All of the teeter-totter or seesaw type of playground apparatuses known to applicant and exemplified in the above-identified U.S. Patents include an interconnection between each of the spaced-apart rocker arms forming part of the playground apparatuses such that movement of one rider will affect and control movement of the other rider, e.g. downward movement of one rider on one rocker arm causes upward movement of an oppositely disposed rider on an oppositely disposed rocker arm, etc. While this sort of ride or movement is desirable in some playground apparatuses of this type, it is undesirable in other uses of playground apparatuses of this type; particularly, when different sizes and weights of riders are involved inasmuch as the larger and heavier rider will in effect completely control the ride and movement of the smaller and lighter rider.

Summary of the Invention

Accordingly, it is the object of this invention to provide playground apparatuses of the teeter-totter or seesaw type for a plurality of riders which are characterized by completely individual movement of each rider wherein movement of any one rider does not affect the movement of any other riders.

It has been found by this invention that the above object may be accomplished by providing playground apparatus, generally as follows.

A generally vertically disposed support means is provided. A plurality of spaced-apart rocker arms having an inner end and an outer end extend generally radially outwardly from said support means. Separate pivot means individually connect the inner end of each of the rocker arms to the support means, without interconnection to the other of the rocker arms, for individual pivotal up and down movement of each of the rocker arms. Separate resilient biasing means are provided for each of the rocker arms for individually biasing each of the rocker arms in an upward direction and for allowing downward movement of each of the rocker arms against the bias thereof. A rider supporting unit is provided on the outer end of each of the rocker arms.

Preferably, the biasing means comprises a coil spring device and further includes means for adjusting the biasing means to increase and/or decrease the biasing force thereof for different size and weight riders.

With the above broad constructional features of playground apparatus in accordance with this invention, a plurality of riders may individually support themselves on the supporting units and effect an independent up and down ride by moving the rocker arms individually about the separate pivot means with and against the bias of the separate biasing means without affecting the movement of the ride of other riders.

BRIEF DESCRIPTION OF THE DRAWINGS

Some of the objects and advantages of this invention having been set forth, other objects and advantages will appear when taken in conjunction with the accompanying drawings, in which.

DESCRIPTION OF PREFERRED EMBODIMENTS

In the accompanying drawings, there are illustrated two preferred embodiments of playground apparatuses 10, 10' constructed in accordance with this invention; however, it is to be understood that other embodiments of playground apparatuses could be constructed utilizing the novel features of this invention.

Figure 1:
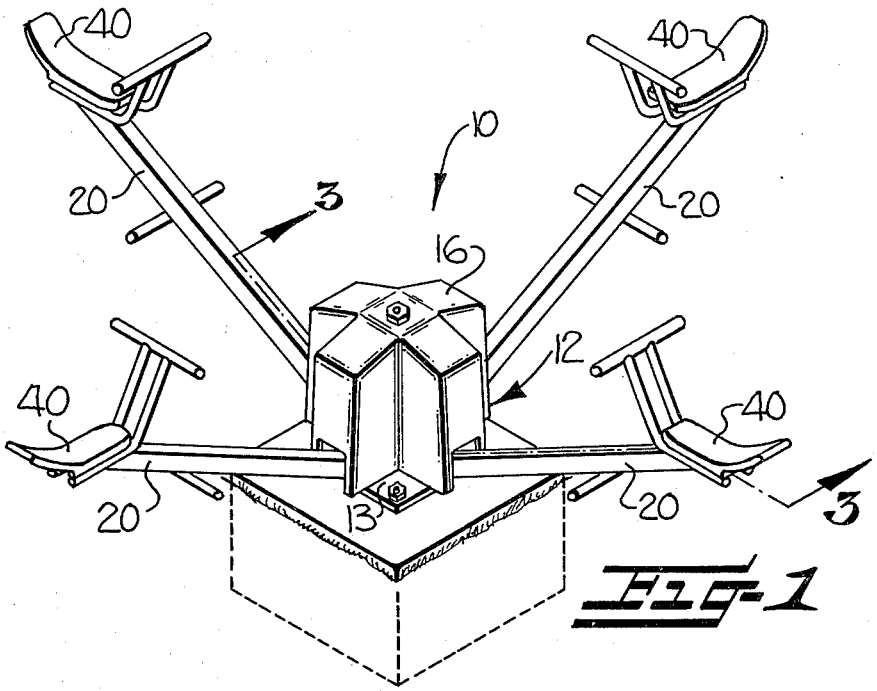
FIG. 1 is a perspective view of a first embodiment of playground apparatus in accordance with this invention.
Figure 2:
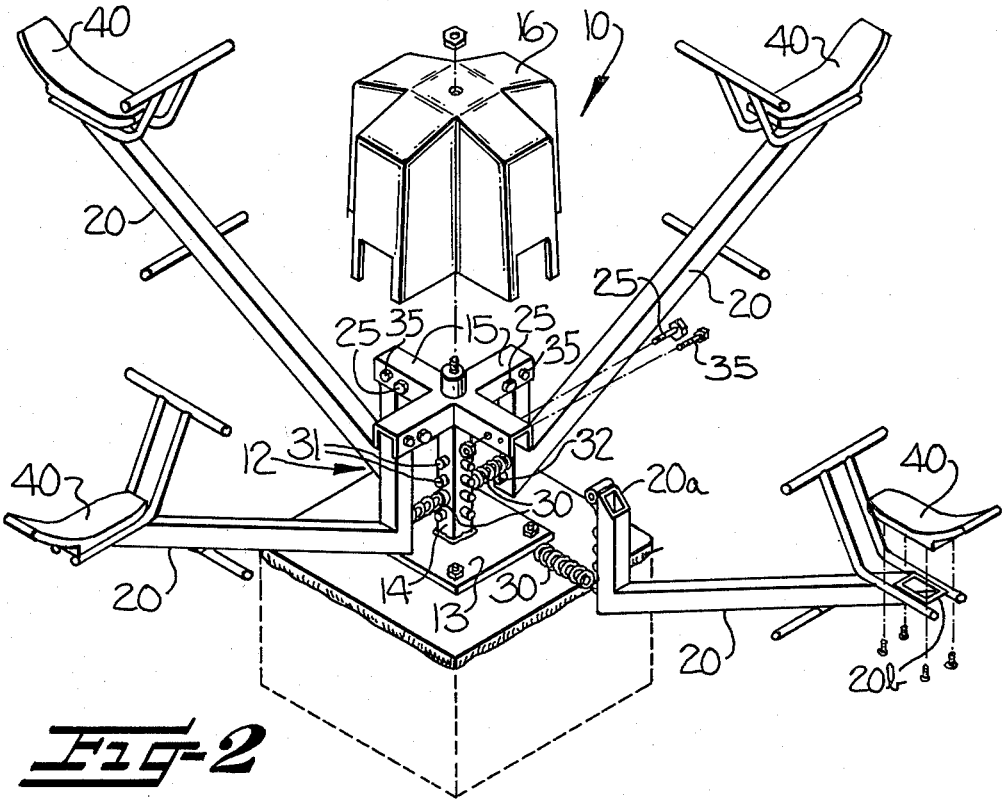
FIG. 2 is a partially exploded, perspective view of the first embodiment of playground apparatus illustrated in FIG. 1.

Referring firstly to the first embodiment of playground apparatus 10, illustrated in FIGS. 1-4, this playground apparatus 10 comprises a generally vertically disposed support means 12. This support means 12 may comprise a base plate 13 secured by bolts or otherwise to the surface upon which the apparatus 10 is resting, such as a cement block embedded in the ground, as illustrated in FIGS. 1 and 2, if the apparatus 10 is located outdoors. The support means 12 may further include an upstanding post member 14 of generally square cross-sectional configuration having four oppositely disposed faces. The support means 12 may further include arms 15 of a generally upside down U-shape configuration extending radially outwardly from the top of the post member 14 and being spaced approximately 90° from each other. The support means 12 may further include a cover member 16 which may be of any desired shape for being placed over and substantially covering the above-described components of the support means 12 and may be bolted to the other components of the support means 12.

The playground apparatus 10 further includes a plurality of spaced-apart rocker arms 20 having an inner end 20*a* and an outer end 20*b* and extending generally radially outwardly from the support means 12. Preferably, the plurality of rocker arms 20 comprises at least two rocker arms spaced approximately equi-distant from each other and preferably four rocker arms spaced approximately 90° from each other, as illustrated in FIGS. 1, 2 and 4. However, it is to be understood that any number of rocker arms 20 may be utilized in accordance with this invention. In the embodiment of FIGS. 1–4, each rocker arm is generally L-shaped with the inner end portion 20*a* forming a first shorter leg and the outer end portion 20*b* forming a second longer leg which are disposed with respect to each other at an acute included angle.

The playground apparatus 10 further includes separate pivot means 25 for individually connecting the inner end 21 of each of the rocker arms 20 to the support means 12, without any interconnection to the other of the rocker arms 20, for individual pivotal up and down movement of each of the rocker arms 20. Each of these pivot means 25 may be in the form of a bolt and nut device, as shown particularly in FIG. 4, which passes through the arms 15 of the support means 12 and through the inner end 20*a* of the rocker arms 20 which may be received within the inverted U-shaped arms 15.

The playground apparatus 10 further includes separate resilient biasing means 30 for each of the rocker arms 20 for individually biasing each of the rocker arms in an upward direction and for allowing downward movement of each of the rocker arms against the bias thereof.

Figure 3:
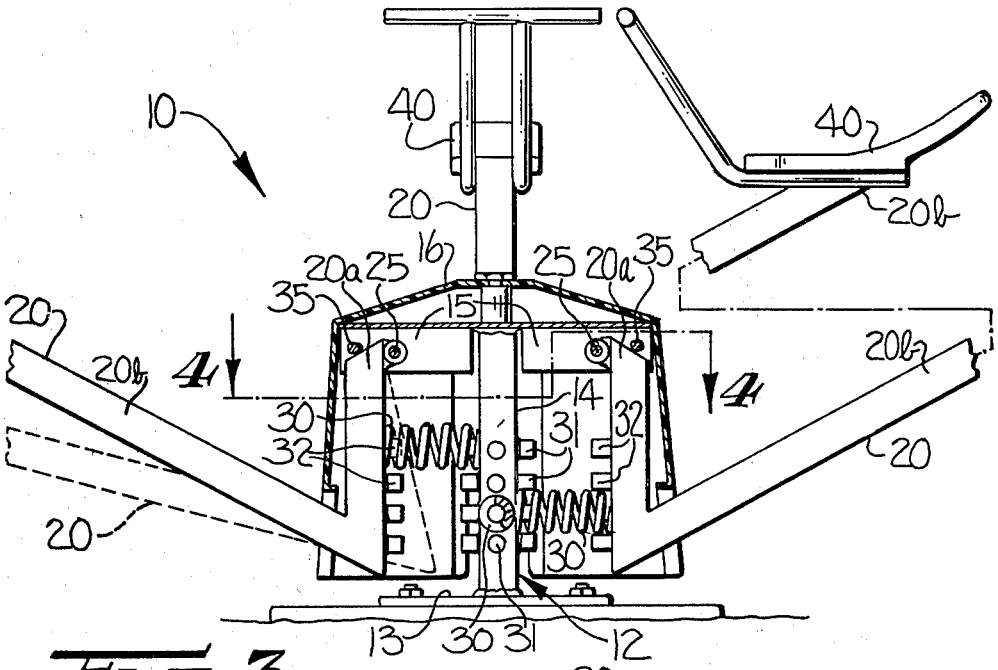
FIG. 3 is a sectional view, taken generally along the line 3—3 of FIG. 1.
Figure 4:
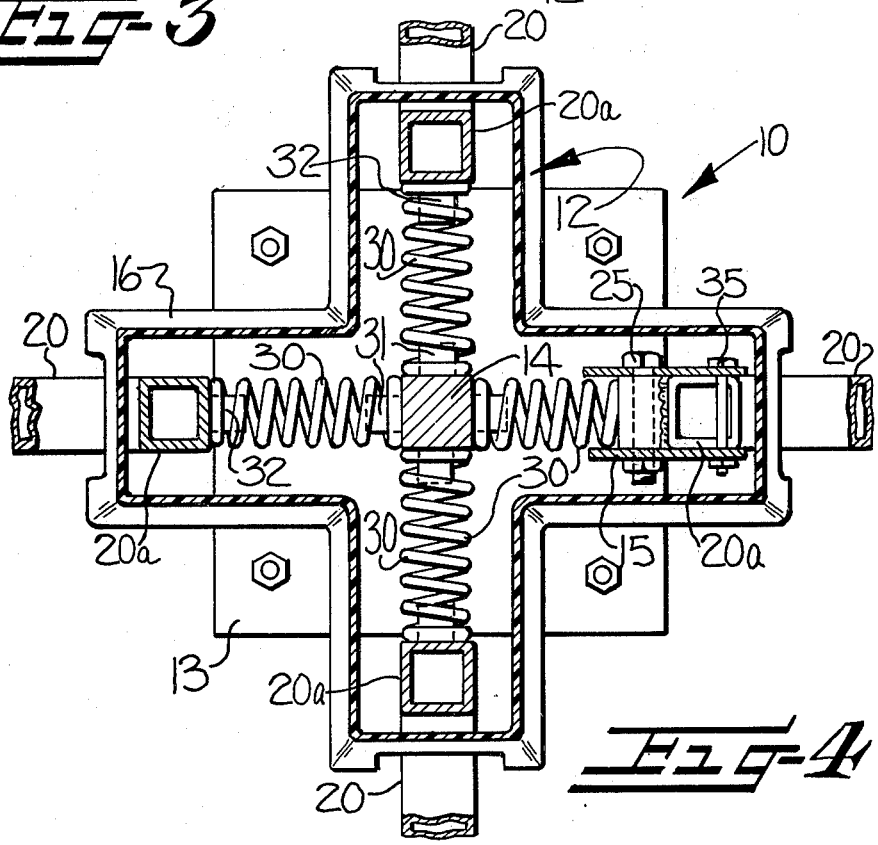
FIG. 4 is a sectional view, taken generally along the line 4—4 of FIG. 3.

These resilient biasing means 30 are preferably in the form of a coil spring, as shown in FIGS. 2–4, extending between each of the rocker arms 20 and a stationary surface, such as a respective face of the upstanding post 14 of the support means 12, for compressing and elongating during the up and down movement of the rocker arms. 20.

Each of the biasing means 30 further preferably includes means for adjusting the biasing means 30 to increase and/or decrease the biasing force thereof for different size and weight riders. In the embodiment of playground apparatus 10 illustrated in FIGS. 1–4, this bias adjusting means comprises serially-arranged, spaced-apart, stud means 31,32 respectively on each of the rocker arms and on the stationary surface, i.e. the respective faces of the upstanding post member 14 of the support means 12, for receiving and positioning each of the coil spring biasing means 30 in a plurality of positions, two of which are illustrated in FIG. 3, for adjusting the biasing means 30 to increase and/or decrease the biasing force thereof for different size and weight riders.

As illustrated in the first embodiment of playground apparatus 10 in FIGS. 1–4, there are four serially arranged studs 31 on each of the faces of the upstanding post 14 of the support means 12 and four serially arranged studs 32 on the inner section 20*a* of each rocker arm 20 for receiving the coil spring biasing means 30 in any one of four positions so that the bias of the coil spring 30 exerted on the respective rocker arm 20 may be increased or decreased according to the chosen position.

The playground apparatus 10 preferably further includes stop means 35, in the form of a pin extending through the respective arms 15 of the support means 12 for abutment by the inner end portion 20*a* of each rocker arm 20 for limiting the upward movement of each respective rocker arm 20.

A rider supporting unit 40 is contained on each of the outer ends 20*b* of each rocker arm 20. This rider supporting unit 40 may be of any desired configuration, such as the seat and bar mechanism along with foot supports illustrated in the drawings for receiving and supporting a rider on the outer end 20*b* of each of the rocker arms 20.

With the above arrangement of playground apparatus 10 in accordance with this invention, a plurality of riders may individually support themselves on the supporting units 40 and effect an independent up and down ride by moving the respective rocker arm 20 individually about its separate pivot means 25 with and against the bias of the separate biasing means 30 without affecting the movement of the ride of other riders. This has not been accomplished with similar types of seesaw or teeter-totter playground apparatuses heretofore known inasmuch as the rocker arms of the prior playground apparatuses were all interconnected in some fashion to each other so that movement of one rider affects movement of another rider.

Figure 5:
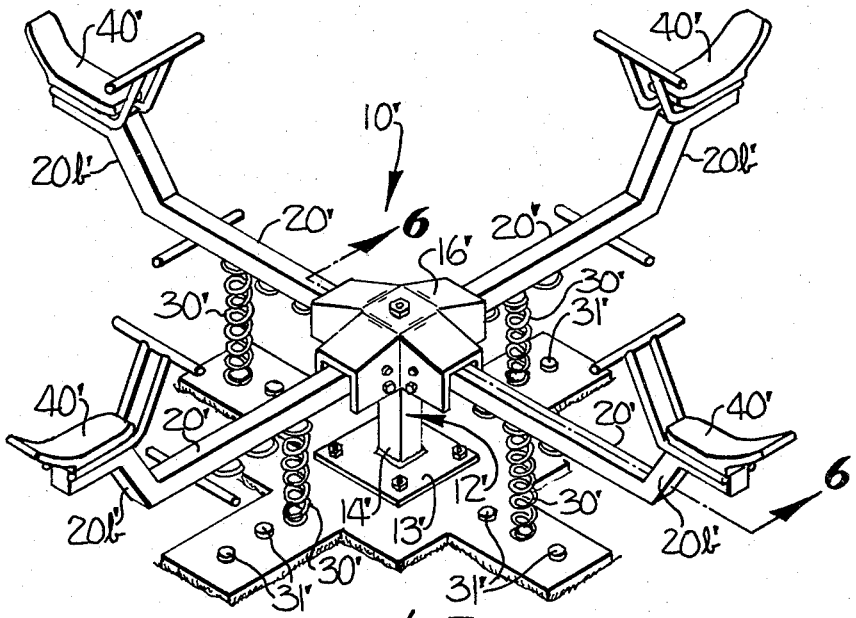
FIG. 5 is a perspective view of a second embodiment of playground apparatus in accordance with this invention.
Figure 6:
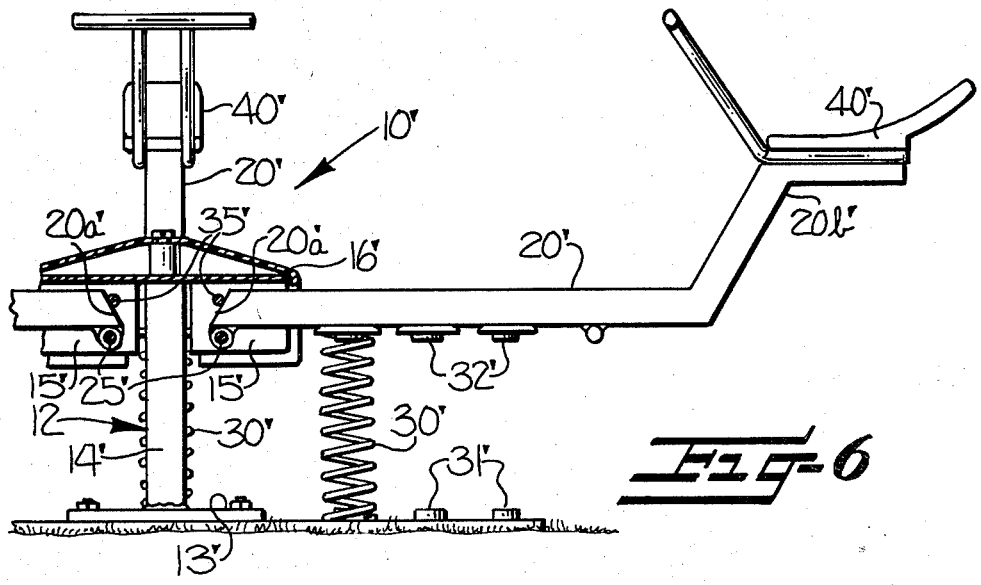
FIG. 6 is a sectional view, taken generally along the line 6—6 of FIG. 5.

Referring now to the second embodiment of playground apparatus 10' in accordance with this invention, illustrated in FIGS. 5 and 6, this playground apparatus 10' utilizes all of the above-described constructional features of the first embodiment of playground apparatus 10 illustrated in FIGS. 1–4 and like reference numerals with prime notations have been applied to these structural features of the second embodiment of playground apparatus 10' in FIGS. 5 and 6.

The differences in the apparatus 10' of FIGS. 5 and 6 and the apparatus 10 of FIGS. 1–4 reside in the shape of the rocker arm 20' with the inner portion 20*a'* *forming a first longer leg and the outer portion 20b' forming a second shorter leg and which are disposed at generally an obtuse angle with respect to each other. Also, the coil spring biasing means 30' extends between each rocker arm 20' and a stationary surface, such as a concrete block upon which the apparatus 10' rests. With this arrangement, the serially arranged, spaced-apart studs 31', 32' will be arranged as illustrated in FIGS. 5 and 6.*

These differences will not alter the operation of the playground apparatus 10' over the playground apparatus 10 and are only illustrative of the different way of constructing playground apparatus in accordance with this invention. It is to be understood that other arrangements of playground apparatus could also be utilized taking advantage of the novel features of this invention.

In the drawings and specification, there have been set forth preferred embodiments of this invention and although specific terms are employed, they are used in a generic and descriptive sense only and not for purposes of limitation.

What is claimed is:

1. Playground apparatus of the teeter-totter or seesaw type which is characterized by a construction providing for a freedom of downward movement under the weight of a rider against a spring bias and ready adjustability of such spring bias for different size and weight riders, said apparatus comprising:

a stationary support means comprising a generally horizontally positioned base means, a generally vertically extending post means secured at a lower end thereof to said base means and extending upwardly from said base means, and at least one generally horizontally extending support arm secured at an inner end thereof to generally an upper end of said post means and extending outwardly from said post means;

at least one movable rocker arm having a rider supporting unit secured to an outer end of said rocker arm for receiving a rider;

pivot means mounting said rocker arm on said support arm of said support means for freedom of generally up and down movement of said rocker arm and rider supporting unit without interference during such movement with said post means of said support means;

spring biasing means operatively positioned between said rocker arm and said support means for compressing and elongating during movement of said rocker arm and rider supporting unit under the weight of the rider; and adjustment means for said spring biasing means comprising a plurality of separate, spaced-apart, serially-arranged means positioned along a portion of said rocker arm for individually, separately and releasably receiving and operatively positioning and retaining one end of said spring biasing means, and a plurality of separate, spaced-apart, serially-arranged means positioned along a portion of said stationary support means which is substantially parallel to the portion of said rocker arm having said spring positioning and retaining means thereon and positioned in opposed facing relationship to said spring positioning and retaining means on said rocker arm for individually, separately and releasably receiving and operatively positioning and retaining the other end of said spring biasing means, whereby, said spring biasing means may be selectively positioned and retained between separate mating pairs of respective spring positioning and retaining means on said rocker arm and said support means for adjusting said biasing means to increase or decrease the biasing force thereof for different size and weight riders.

2. Playground apparatus, as set forth in claim 1 in which said spring biasing means comprises a coil spring, and each of said spring positioning and retaining means on said rocker arm and said support means comprises an outwardly extending stud having one end thereof secured to said respective rocker arm or support means and the other end free for releasably receiving and operatively positioning and retaining one end of said coil spring biasing means.

3. Playground apparatus, as set forth in claim 1, in which said apparatus further includes stop means operatively associated with said rocker arm for limiting the upward movement thereof.

4. Playground apparatus, as set forth in claim 1, 2 or 3, in which said spring positioning and retaining means on said stationary support means are positioned on said post means of said support means and said spring biasing means is operatively positioned between said rocker arm and said post means of said support means.

5. Playground apparatus, as set forth in claim 1, 2 or 3, in which said spring positioning and retaining means on said stationary support means are positioned on said base means of said support means and said spring biasing means is operatively positioned between said rocker arm and said base means of said support means.

6. Playground apparatus of the teeter-totter or seesaw type which is characterized by a construction providing for freedom of downward movement under the weight of a rider against a spring bias and ready adjustability of such spring bias for different size and weight riders, said apparatus comprising:

a stationary support means comprising a generally horizontally positioned base means, a generally vertically extending post means secured at a lower end thereof to said base means and extending upwardly from said base means, and four generally horizontally extending support arms secured at an inner end thereof to generally an upper end of said support means and extending outwardly from said support means and being spaced-apart approximately 90° from each other;

four movable rocker arms having a rider supporting unit secured to an outer end of each of said rocker arms for receiving a rider on each of said supporting units;

separate pivot means for individually mounting each of said rocker arms on a respective one of said support arms of said support means for freedom of generally up and down movement of said rocker arms and said rider supporting unit without interference during such movement with said post means of said support means and without interconnection to any other of said rocker arms for individual pivotal up and down movement of each of said rocker arms;

four separate spring biasing means respectively operatively positioned between each of said rocker arms and said support means for individually compressing and elongating during respective movement of said rocker arms and rider supporting unit under the weight of each of the riders; and individual adjustment means for each of said spring biasing means comprising a plurality of separate, spaced-apart, serially-arranged means positioned along a portion of each of said rocker arms for individually, separately and releasably receiving and operatively positioning and retaining one end of said respective spring biasing means, and a plurality of separate, spaced-apart, serially-arranged means positioned along a portion of said stationary support means which is substantially parallel to the portion of said respective rocker arm having said spring positioning and retaining means thereon and positioned in opposed, facing relationship to said spring positioning and retaining means on said respective rocker arm for individually, separately and releasably receiving and operatively positioning and retaining the other end of said respective spring biasing means, whereby, each of said spring biasing means may be separately, selectively positioned and retained between separate mating pairs of respective spring positioning and retaining means on said respective rocker arms and said support means for separately adjusting each of said biasing means to increase or decrease the biasing force thereof for different size and weight riders.

7. Playground apparatus, as set forth in claim 6, in which each of said spring biasing means comprises a coil spring, and each of said spring positioning and retaining means on said rocker arms and said support means comprises an outwardly extending stud having one end thereof secured to said respective rocker arm or support means and the other end free for releasably receiving and operatively positioning and retaining one end of a respective one of said coil spring biasing means.

8. Playground apparatus, as set forth in claim 6, in which said apparatus further includes stop means operatively associated with each said rocker arm for limiting the upward movement thereof.

9. Playground apparatus, as set forth in claim 6, 7 or 8, in which said spring positioning and retaining means on said stationary support means are positioned on said post means of said support means and each of said spring biasing means is operatively positioned between a respective one of said rocker arms and said post means of said support means.

10. Playground apparatus, as set forth in claim 6, 7 or 8, in which said spring positioning and retaining means on said stationary support means are positioned on said base means of said support means and each of said spring biasing means is operatively positioned between a respective one of said rocker arms and said base means of said support means.

* * * * *